US007261458B2

(12) United States Patent
Janning

(10) Patent No.: US 7,261,458 B2
(45) Date of Patent: Aug. 28, 2007

(54) SEMICONDUCTOR CHIP WITH CONTAINER AND CONTACT ELEMENTS FOR USE IN A LIGHT SOCKET

(76) Inventor: John L. Janning, 332 Vindale Dr., Dayton, OH (US) 45440

( * ) Notice: Subject to any disclaimer, the term of this patent is extended or adjusted under 35 U.S.C. 154(b) by 192 days.

(21) Appl. No.: 10/908,365

(22) Filed: May 9, 2005

(65) Prior Publication Data

US 2005/0258777 A1 Nov. 24, 2005

Related U.S. Application Data

(63) Continuation-in-part of application No. 10/611,744, filed on Jul. 1, 2003, now Pat. No. 6,929,383.

(51) Int. Cl.
*H01R 33/00* (2006.01)
*F21S 4/00* (2006.01)
*H05B 37/04* (2006.01)

(52) U.S. Cl. ..... 362/652; 362/227; 315/121; 315/185 R

(58) Field of Classification Search ..... 315/121, 315/122, 129, 185 R, 185 S, 192, 312, 324; 362/227, 234, 249, 251, 652, 647
See application file for complete search history.

(56) References Cited

U.S. PATENT DOCUMENTS

| | | | | |
|---|---|---|---|---|
| 2,072,337 | A | 3/1937 | Kamm | 315/122 |
| 3,345,482 | A | 10/1967 | Lou | 315/122 |
| 4,727,449 | A | 2/1988 | Fleck | 315/122 |
| 4,769,579 | A | 9/1988 | Jou | 315/201 |
| 4,922,155 | A * | 5/1990 | Morris et al. | 315/205 |
| 5,442,258 | A | 8/1995 | Shibata | 315/129 |
| 6,084,357 | A | 7/2000 | Janning | 315/122 |
| 6,580,182 | B2 | 6/2003 | Janning | 307/36 |
| 6,713,971 | B1 * | 3/2004 | Wong | 315/185 S |

* cited by examiner

*Primary Examiner*—Alan Cariaso
(74) *Attorney, Agent, or Firm*—R. William Graham

(57) ABSTRACT

A shunt device for use in a light socket includes a first semiconductor chip and a first container having a receiving surface for receiving the first semiconductor chip therein and having an open surface through which the first semiconductor chip is exposed and a first conductive member connected having a first end connected to the first semiconductor chip through the open surface and a second end connected to a first of the terminals with the socket and wherein the container and the chip and the member are operatively interposed in a self retained manner between the terminals in the lower portion of the socket.

20 Claims, 12 Drawing Sheets

SEMICONDUCTOR CHIP WITH CONTAINER AND CONTACT ELEMENTS FOR USE IN A LIGHT SOCKET

DESCRIPTION

This is a continuation-in-part of application U.S. Ser. No. 10/611,744 filed Jul. 1, 2003 now U.S. Pat. No. 6,929,383.

FIELD OF INVENTION

The present invention relates to a lamp socket for light strings having lights arranged in series. More particularly, the invention relates to a semiconductor chip container with chip therein for use in a light socket forming a shunt to allow for electricity to continually conduct throughout the light string keeping the remainder of the lights lit when one or more lights on the string burn out, become dysfunctional or are removed from a socket.

BACKGROUND OF THE INVENTION

Decorative light strings which are connected in series are highly popular in the United States, especially during holidays in November and December. A drawback with such light strings is that they commonly include of a plurality of individual light units with bulbs which are electrically connected in series and not in parallel. The bulbs are typically incandescent bulbs having a filament formed between two leads of the bulb, the filament giving off light when a current is passed from one lead to the other, through the filament. As the bulb is used, over time, the filament will burn out, breaking the series circuit in which the bulb is arranged. This will cause the entire light string to go out unless a backup circuit path is available to bypass the failed filament.

Presently, inside of the mini-light bulb, there is a backup circuit path having a shunt system arranged in parallel with the filament of each bulb. This shunt is comprised of three turns of aluminum wire with an insulating (oxide) coating. When the filament is intact, current passes through the filament because the resistance of the filament is low compared to that of the insulating material on the shunt. However, when the filament burns out, the voltage across the leads of the bulb increases to the full line potential of 120 volts AC. The actual peak voltage at 120 volts AC is approximately 170 volts. The insulating coating on the shunt wire is designed to break down at a minimum of 40 volts to provide a backup circuit path around the failed filament. However, this 'shorting' mechanism only works about 70% of the time. When it fails to operate, the entire series-wired light string goes out.

One solution that allows the circuit to continue to function when there is a failure as described above is taught in U.S. Pat. Nos. 6,084,357 and 6,580,182 which is issued to the same inventor herein. The solution is to provide a backup circuit path having a semiconductor shunt system arranged in parallel with the filament of each bulb. As described in the above mentioned issued patents, the semiconductor device might be a diode array or back-to-back Zener diodes. In this manner, even if a bulb burns out, breaks, or falls out of its socket, the rest of the light units in the light string remain on because the series circuit remains closed. The system employed in the above issued patents is the shunting of each light bulb in the string with such a semiconductor shunt mounted in a package as the standard DO-41 package. The DO-41 package housing the semiconductor chip is placed inside of each socket and is electrically connected to the light bulb's conductive connection in the socket.

In addition, co-pending U.S. application Ser. No. 10/611,744 described a further improvement in wherein a shunt device included a semiconductor chip held in place by a spring-like conductive member. While this improvement has met with success, the shunt device is difficult to work with due to the diode chip size being extremely small (i.e., chip size is 0.028"×0.028") and current implementation is relatively expensive.

While the functionality of decorative light strings using the inventor's prior shunt devices work well, there remains a need to improve the shunt device as set forth herein and reduce the cost of producing the decorative light string.

BRIEF SUMMARY OF THE INVENTION

It is an object to improve decorative light strings.

It is another object to reduce the cost of decorative light strings.

It is a further object to provide a semiconductor chip operably disposed within a container inside of a light socket.

Accordingly, an embodiment of the present invention is directed to a shunt device for use in a light socket having a semiconductor chip operably disposed within a container having an open surface through which the semiconductor chip is exposed and held in place by a conductive member which contacts the chip through the open surface. Another embodiment provides for the container and chip to be held in place by conductive leads having ends which plug into electric terminals of the socket. Still another embodiment is directed to a pair of bent conductive members having the container and chip held therebetween. In yet another embodiment, the conductive members can be modified to include retention fingers which are opposing each other in a spaced relationship in a manner to form a retaining seat for the container and chip which can be preferably held therebetween. Still another embodiment provides for a chip and container to be directly connected to each conductive terminal and have a conductive wire interconnecting the two chips, wherein each chip is intended to dissipate half of the power keeping the socket from overheating in cases where too much current is drawn, such as when higher watt light bulbs are used.

The light socket of the instant invention is for use with a light string having at least two light sockets connected in series via wire segments having associated contact elements. A light bulb is receivable by each socket and can be removed and replaced when a filament of the bulb burns out.

Other objects will be revealed by the following description and drawings.

DETAILED DESCRIPTION OF THE PREFERRED EMBODIMENT

Figure 1:
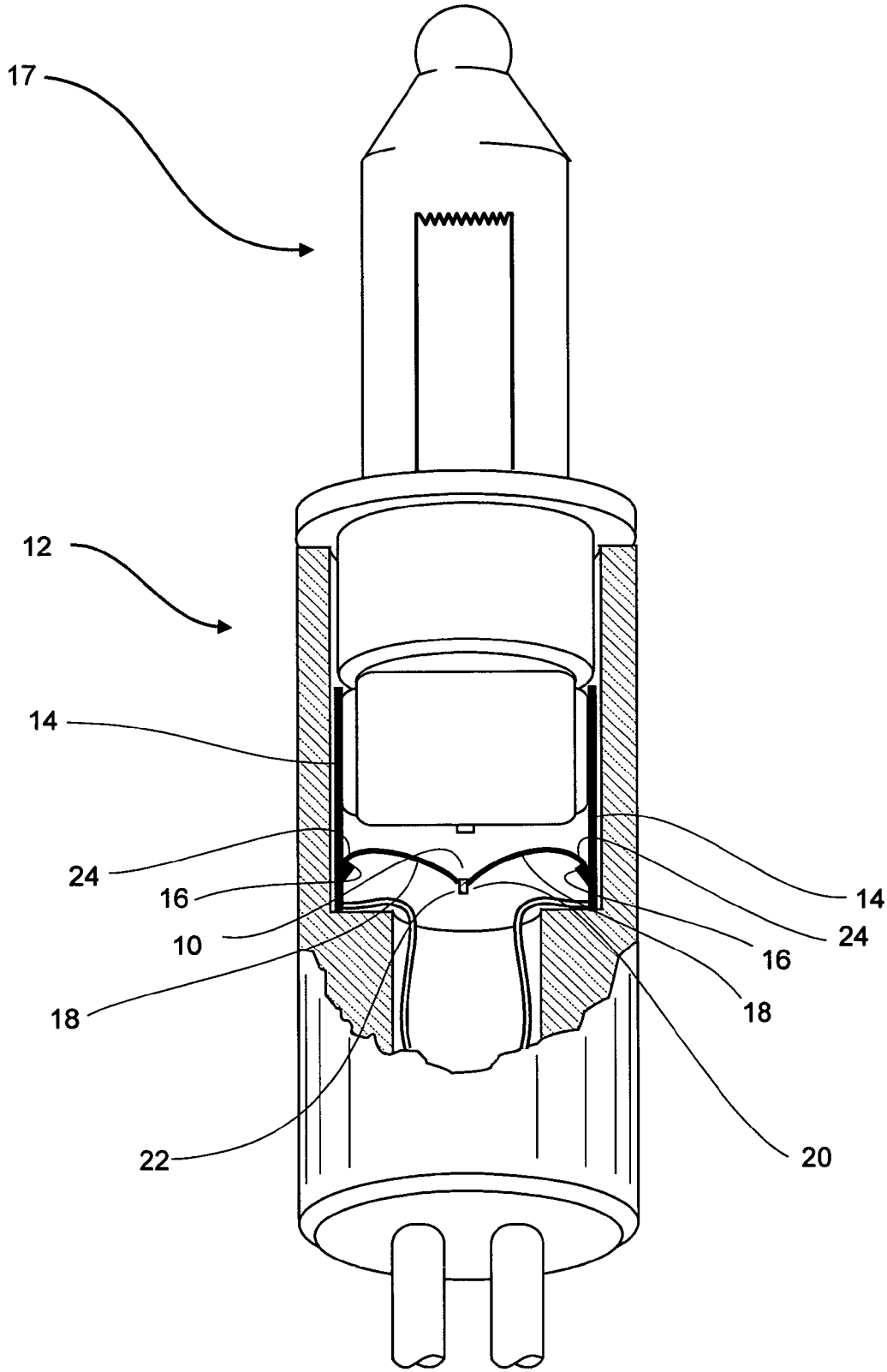
FIG. 1 is a partial sectional view of one embodiment of the invention.

Referring now to the drawings, the semiconductor chip of the present invention is generally designated by the numeral 10. The semiconductor chip 10 is a relatively flat and thin plate which is of the type described in co-pending application Ser. No. 10/611,744. The chip 10 is used in various embodiments described herein. The chip 10 is very small having a size of about 0.028"×0.028". The handling of this chip 10 is difficult from an integration and cost standpoint into a socket 12.

Accordingly, the improvement in present invention provides a container 1000 made of a nonconductive material such as plastic. The container 1000 can include a pair of interconnectable members 1002 and 1004 which are here shown by way of example to be rectangular, but it is recognized that other shapes can be employed. Members 1002 and 1004 can be of a dimensional size of about 0.20"×0.20" for ease of insertion. The member 1002 includes tab retention surface 1006 which extends inwardly from a mating surface 1008 and tab 1100 which extends outwardly from the mating surface 1008. Likewise, member 1004 includes tab retention surface 1012 which extends inwardly from a mating surface 1014 and tab 1016 which extends outwardly from the mating surface 1014. The members 1002 and 1004 can be mated such that the tabs 1010 and 1016 are of a size, configuration and orientation to be received within the respective tab retention surfaces 1012 and 1006 in a friction fit manner to retain the members 1002 and 1004 together. In addition, a chip receiving surface 1018 extends inwardly from mating surface 1008 and a chip exposing surface 1020 extends inwardly from an outer surface 1022 terminating into a shoulder surface 1024 which connects to the chip receiving surface 1018. Likewise, a chip receiving surface 1026 extends inwardly from mating surface 1014 and a chip exposing surface 1028 extends inwardly from an outer surface 1030 terminating into a shoulder surface 1032 which connects to the chip receiving surface 1026. The chip receiving surfaces 1018 and 1026 are slightly larger than the dimensions of the chip 10. The mating surfaces 1008 and 1014 can preferably be generally planar and flat to provide for a mating connection without a gap therebetween, save for the described receiving surfaces 1018 and 1026. Prior connecting the members 1002 and 1004, the chip 10 is disposed in chip receiving surface 1018, for example, to rest on shoulder surface 1024. Then, the member 1004 is mated with member 1002 as described to secure the chip in a retained manner within the receiving surfaces 1018 and 1026.

Figure 10:
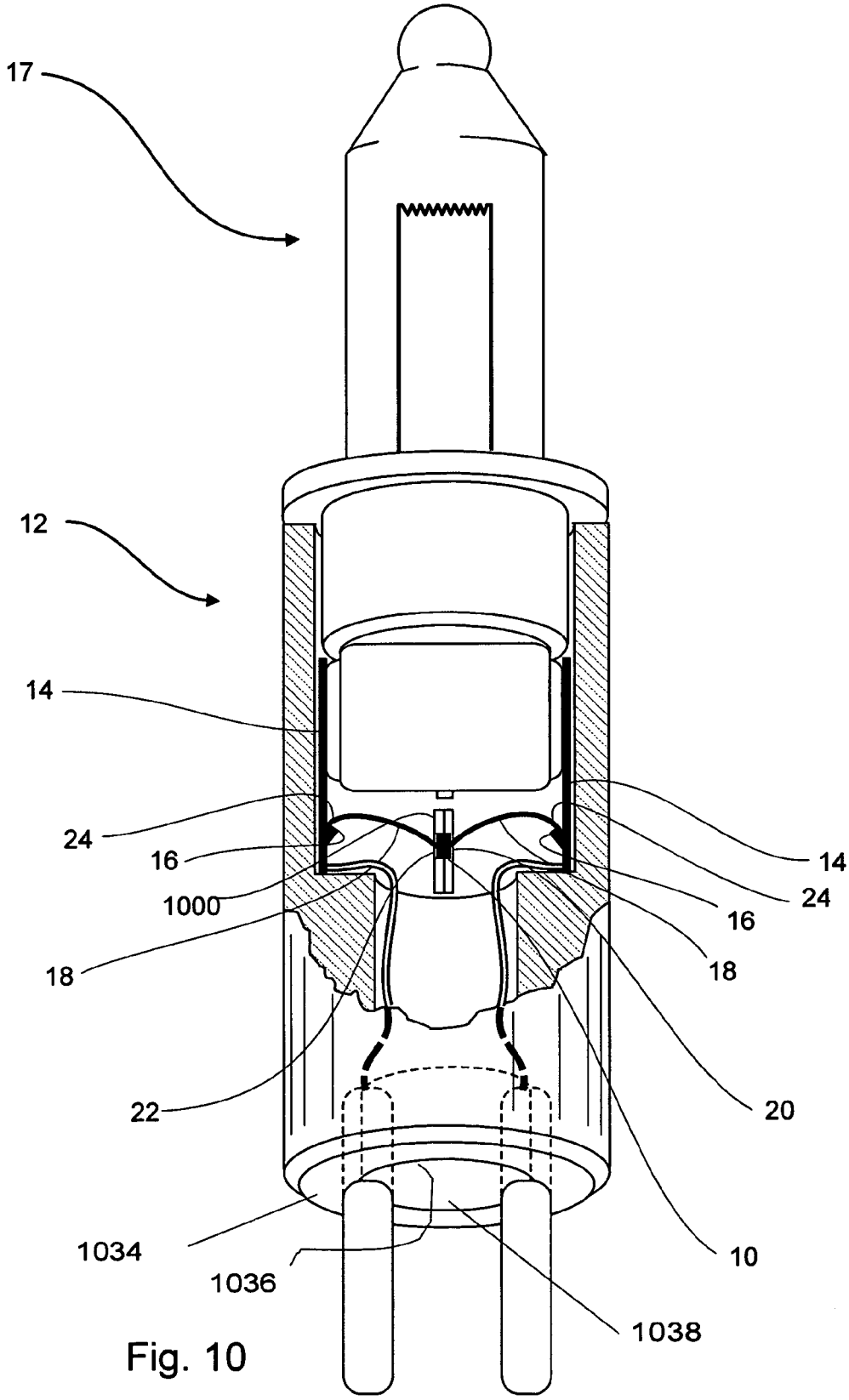
FIG. 10 is a partial sectional view of another embodiment of the invention employing the container and chip of FIG. 7.

FIG. 1 shows a modified light socket 12 having conductive terminals 14 on each side with plug-in socket surfaces 16 formed therein in a portion of each terminal 14 where a light bulb 17 normally seats when operatively disposed within the socket 12. The light bulb 17 has a pair of conductive leads which connect to a filament contained within a glass envelope. The chip 10 may include operatively connected conductive leads 18, wherein one lead 18 extends from each side 20 and 22 of the chip 10 and can be bonded thereto by a conductive epoxy, for example. A terminal end 24 of each lead 18 is configured to be operatively received into the plug-in socket surfaces 16. The leads 18 can be of a suitable conductive material such as copper. FIG. 10 shows a similar embodiment with the container 1000 having chip 10 therein operably disposed between the leads 18.

Figure 2:
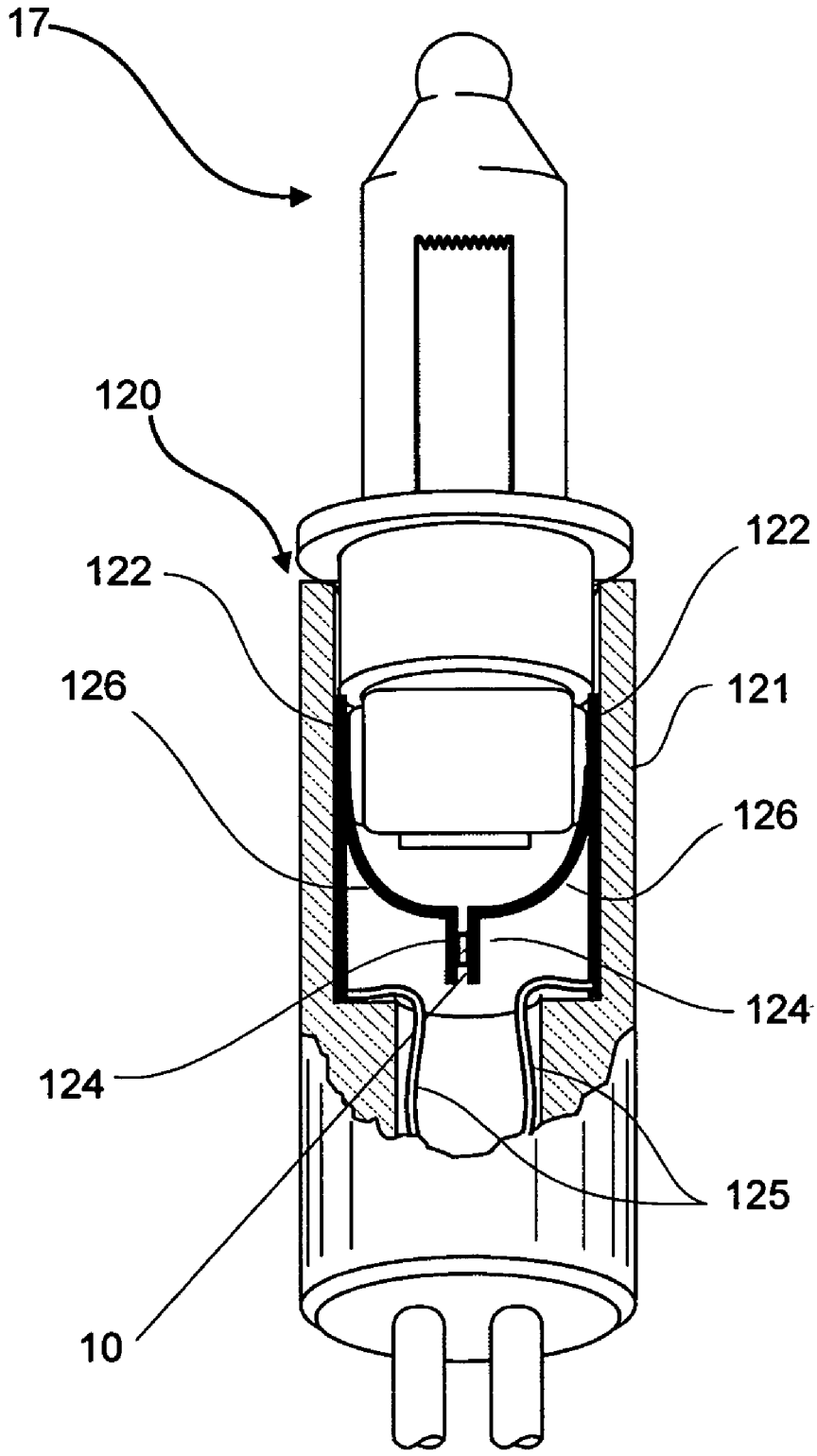
FIG. 2 is a partial sectional view of another embodiment.
Figure 11:
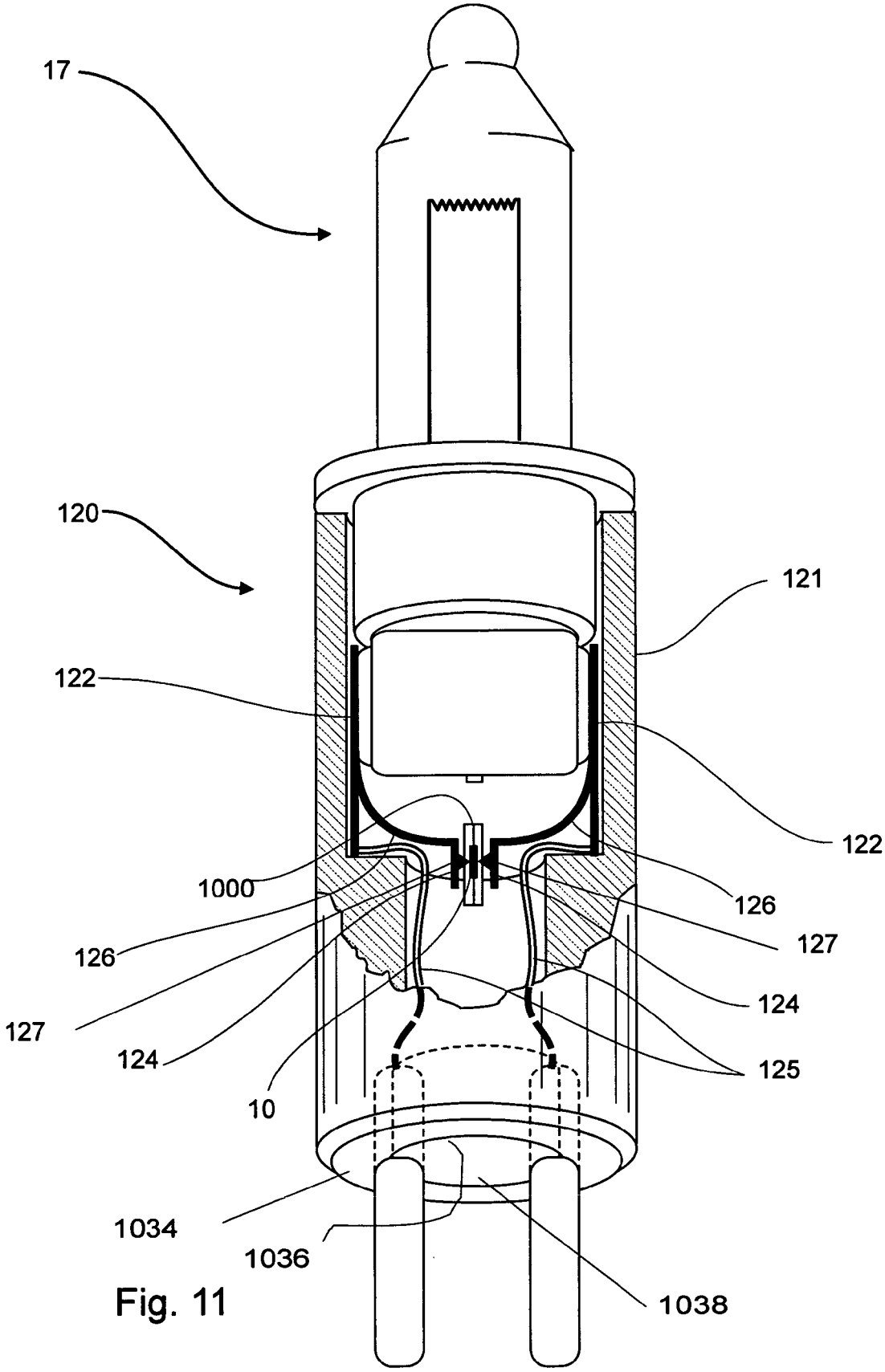
FIG. 11 is a partial sectional view of another embodiment employing the container and chip of FIG. 7.

FIG. 2 shows an alternative embodiment wherein the semiconductor chip 10 is bonded to bent conductive members 126 which each have an inwardly disposed flange 124. The socket 120 has a housing 121 to receive the light bulb 17 and a pair of opposing conductive terminals 122. The terminals 122 are connected to wires 125 which operatively extend outside the housing 120. The chip 10 can be bonded, e.g., with an epoxy, to flange 124. When operatively disposed, the chip 10 is disposed adjacent and between the flanges 124. FIG. 11 shows a similar embodiment with the container 1000 having chip 10 therein operably disposed between the bent ends 124 having a detent portion 127 for contacting and securing the container 1000 and chip 10. Similarly, an epoxy can be employed to bond the container 1000 and chip 10 to at least one of the flanges 124.

Figure 3:
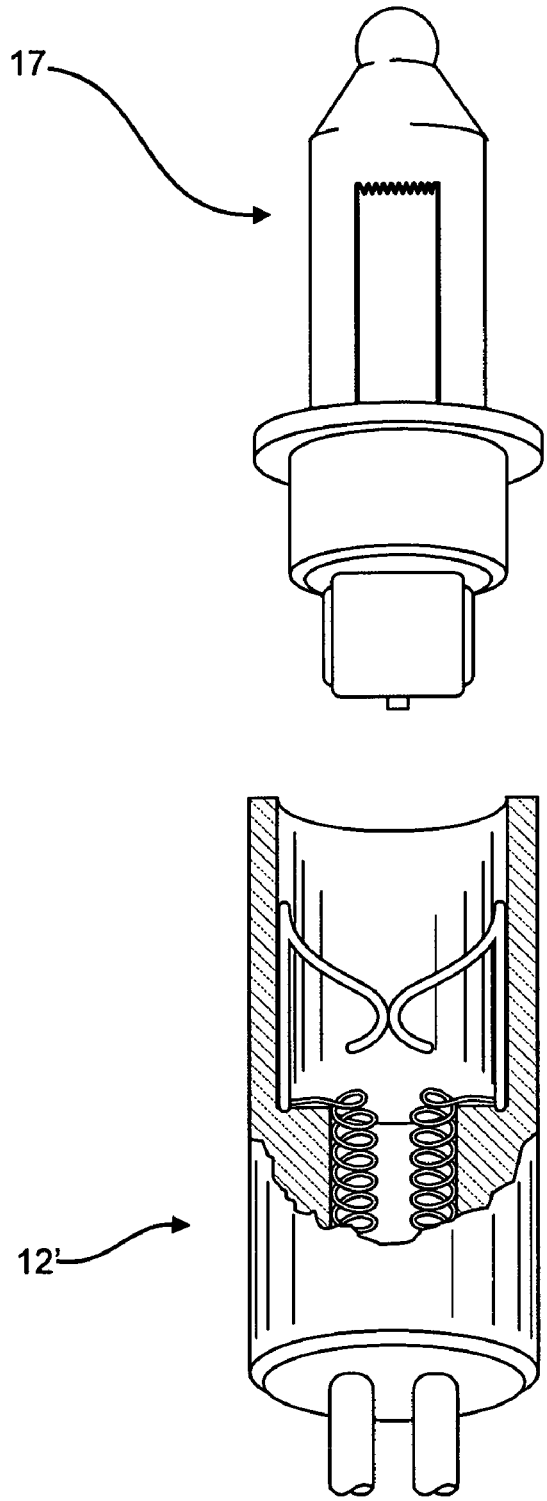
FIG. 3 is a partial sectional view of an existing socket.

FIG. 3 shows an existing socket 12' and bulb 17. The socket 12' shorts when the bulb 17' is removed.

Figure 4A:
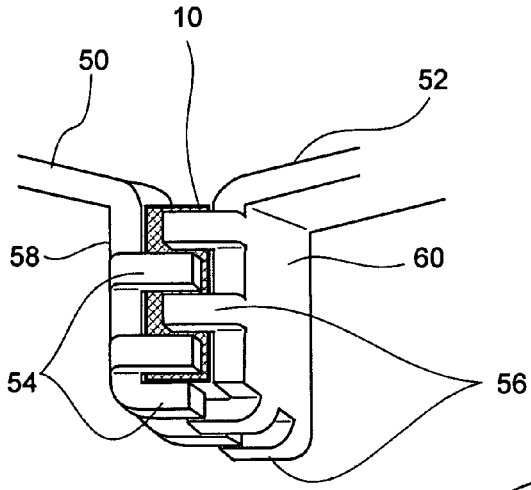
FIG. 4*a* is a blow up of a part of FIG. 4.
Figure 4:
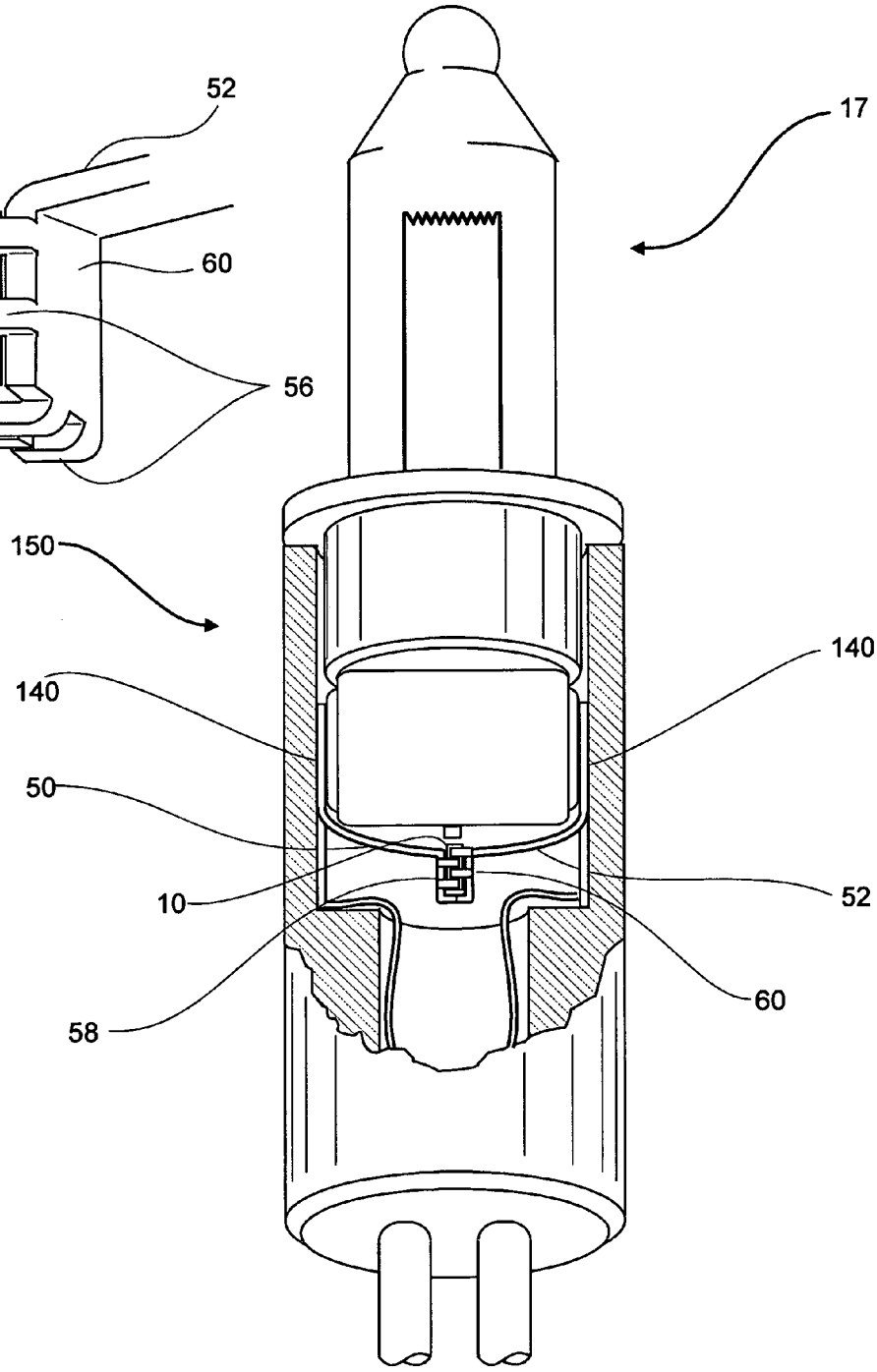
FIG. 4 is a partial sectional view of yet another embodiment of the invention.
Figure 12A:
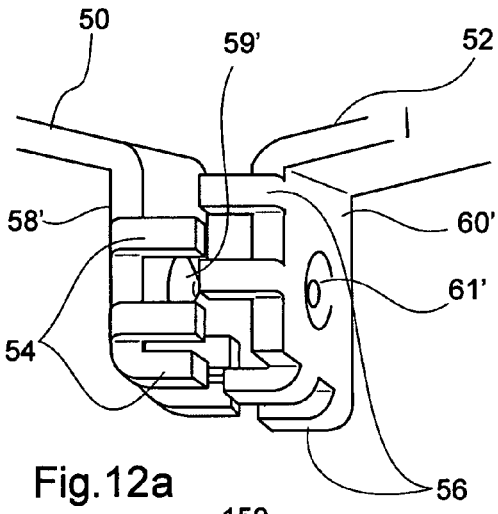
FIG. 12*a* is a blow up of a part of FIG. 12 employing the container and chip of FIG. 7.
Figure 12:
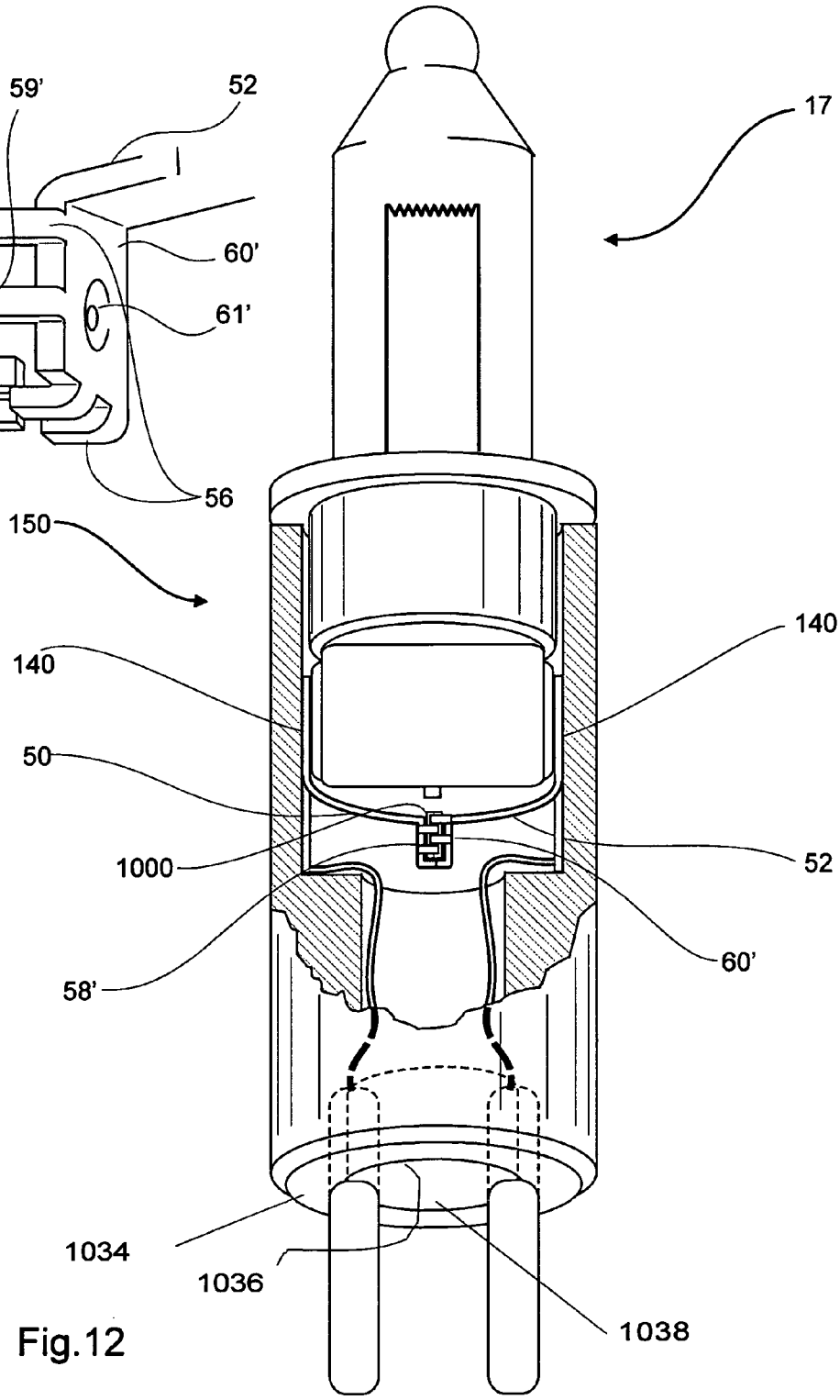
FIG. 12 is a partial sectional view of yet another embodiment of the invention employing the container and chip of FIG. 7.

In yet another embodiment, FIG. 4 shows bent conductive terminals 50 and 52 having retention fingers 54 and 56, respectively, which are opposing each other in a spaced relationship such that the fingers 54 and 56 do not touch. The terminals 50 and 52 contact conductive terminals 140. The fingers 54 and 56 can be set at an angle to aid in this regard. When operatively disposed in socket 150, the fingers 54 and 56 form part of a retaining seat for chip 10 along with lower portions 58 and 60 of the terminals 50 and 52, respectively. The chip 10 can be inserted between terminals 50 and 52 so that the terminals 50 and 52 do not touch. FIG. 12 shows a similar embodiment with the container 1000 having chip 10 therein operably disposed between the lower portions 58' and 60'. As seen in FIG. 12*a*, lower portions 58' and 60' can be formed with a detent 59' and 61' which serve to contact the chip 10 through the open surfaces 1020 and 1028.

Figure 5:
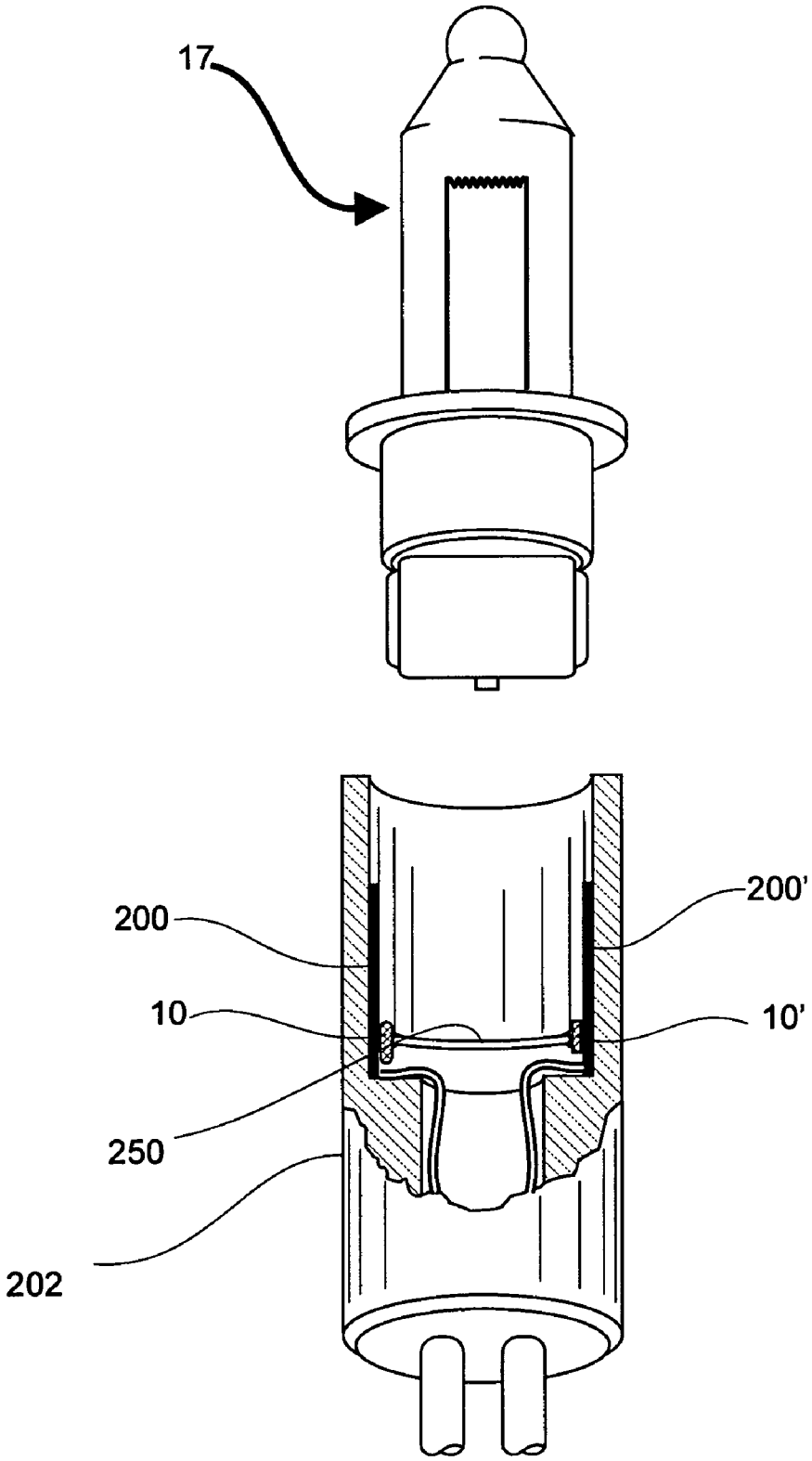
FIG. 5 is a partial sectional view of still another embodiment of the invention.

Still another embodiment shown in FIG. 5 provides for chips 10 and 10' (which are similarly constructed) to be conductively directly connected to conductive terminals 200 and 200' within socket 202. Again, the chips 10 and 10' can be bonded directly to the terminals 200 and 200' on one side. A conductive wire 250 interconnects the two chips 10 and 10' and likewise the ends of the wire 250 can be press fit between (and optionally bonded) to the other side of each respective chip 10 and 10'. Each chip 10 and 10' is intended to dissipate half of the power keeping the socket 202 from overheating in cases where too much current is drawn, such as when higher watt light bulbs are used.

Figure 13:
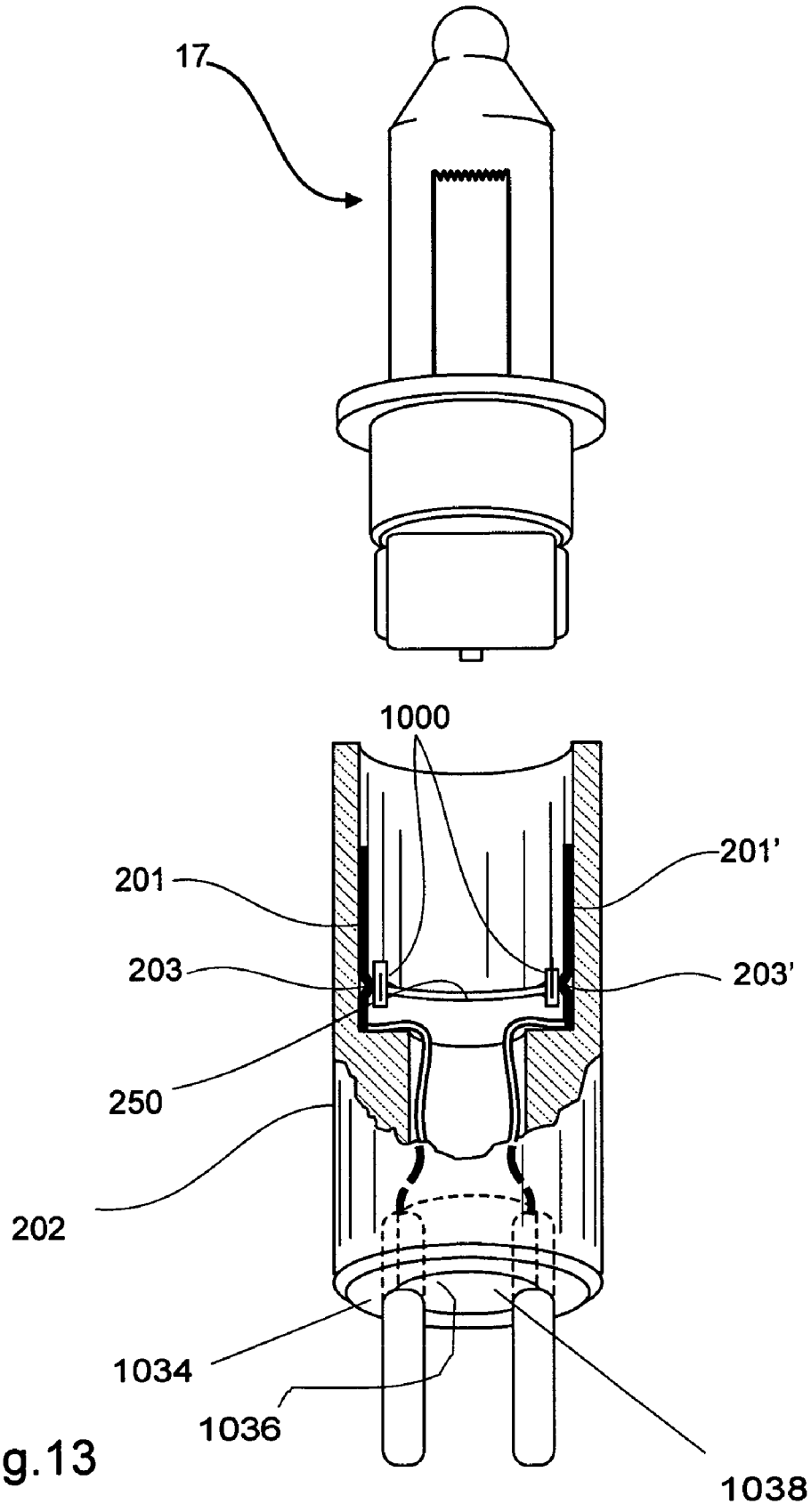
FIG. 13 is a partial sectional view of still another embodiment of the invention employing the container and chip of FIG. 7.

FIG. 13 shows a similar embodiment with the container 1000 having chip 10 therein operably disposed between the leads wire 250. Here, terminals 201 and 201' can include an inwardly protruding portion 203 and 203' to assure contact of the chip 10 within the container 1000.

Figure 6:
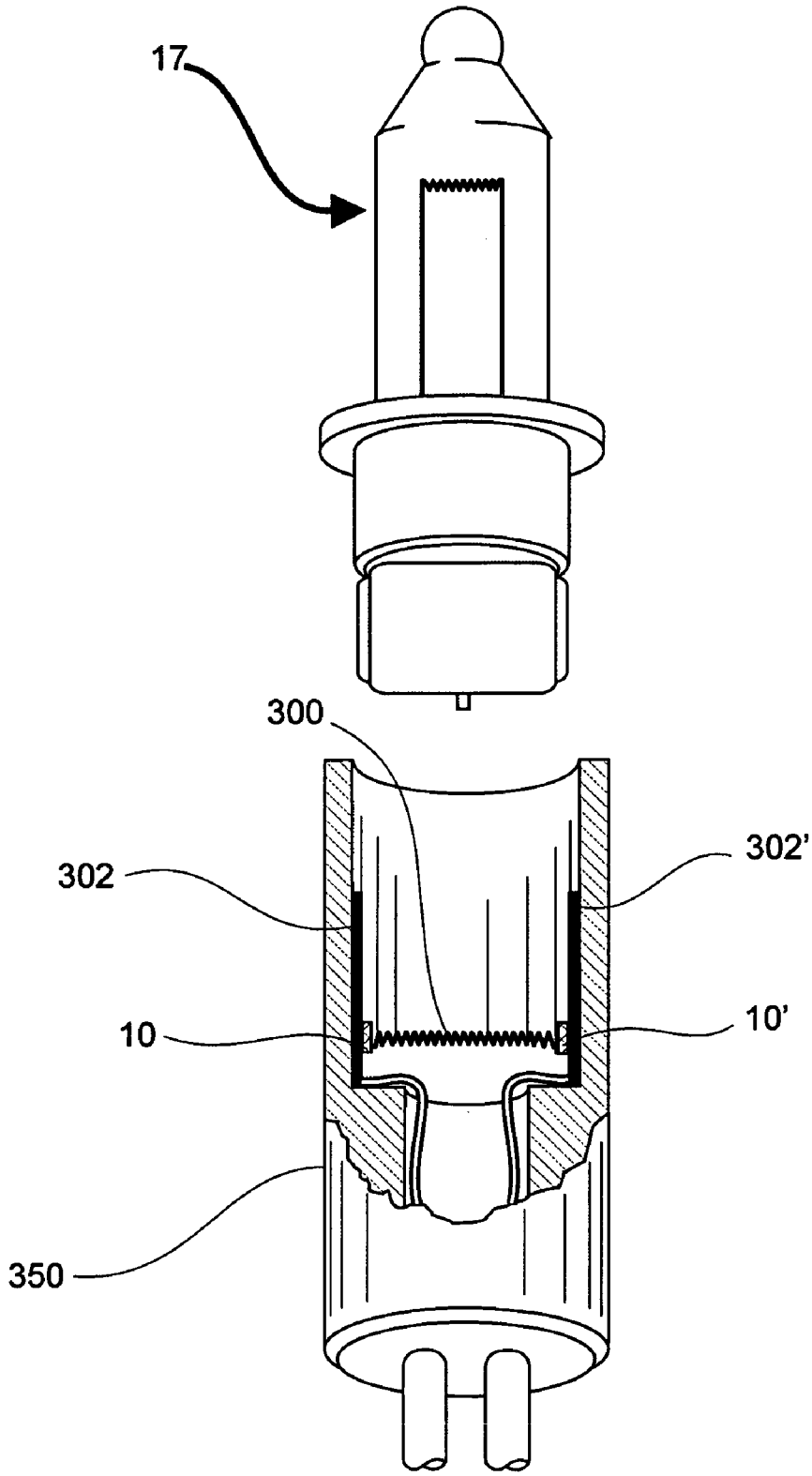
FIG. 6 is a partial sectional view of another embodiment of the invention.
Figure 7:
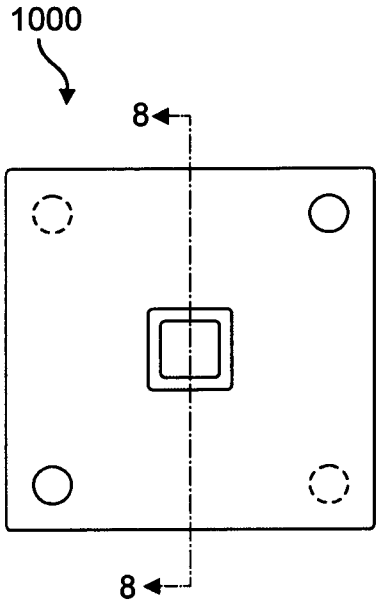
FIG. 7 is a plan view of a container for a chip for use in the invention.
Figure 8:
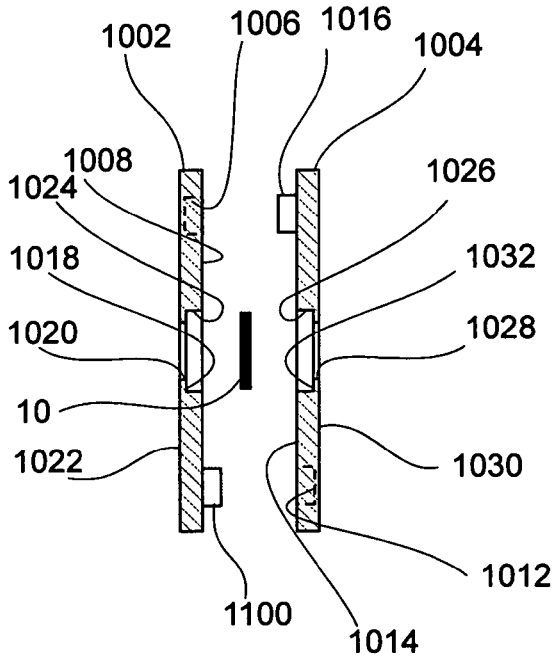
FIG. 8 is an exploded side cross sectional view of the container and chip of FIG. 7 taken through line 8-8.
Figure 9:
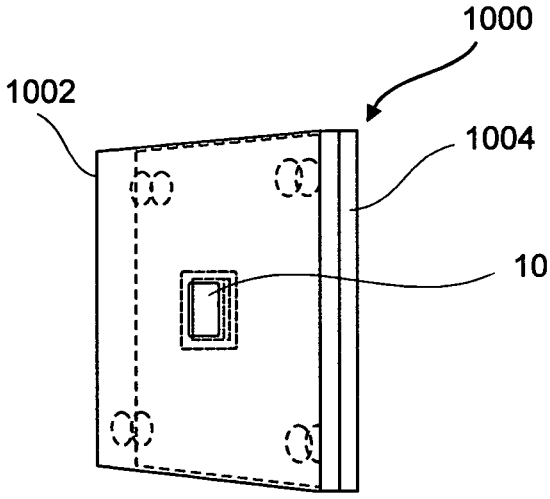
FIG. 9 is a perspective of the container and chip of the invention.
Figure 14:
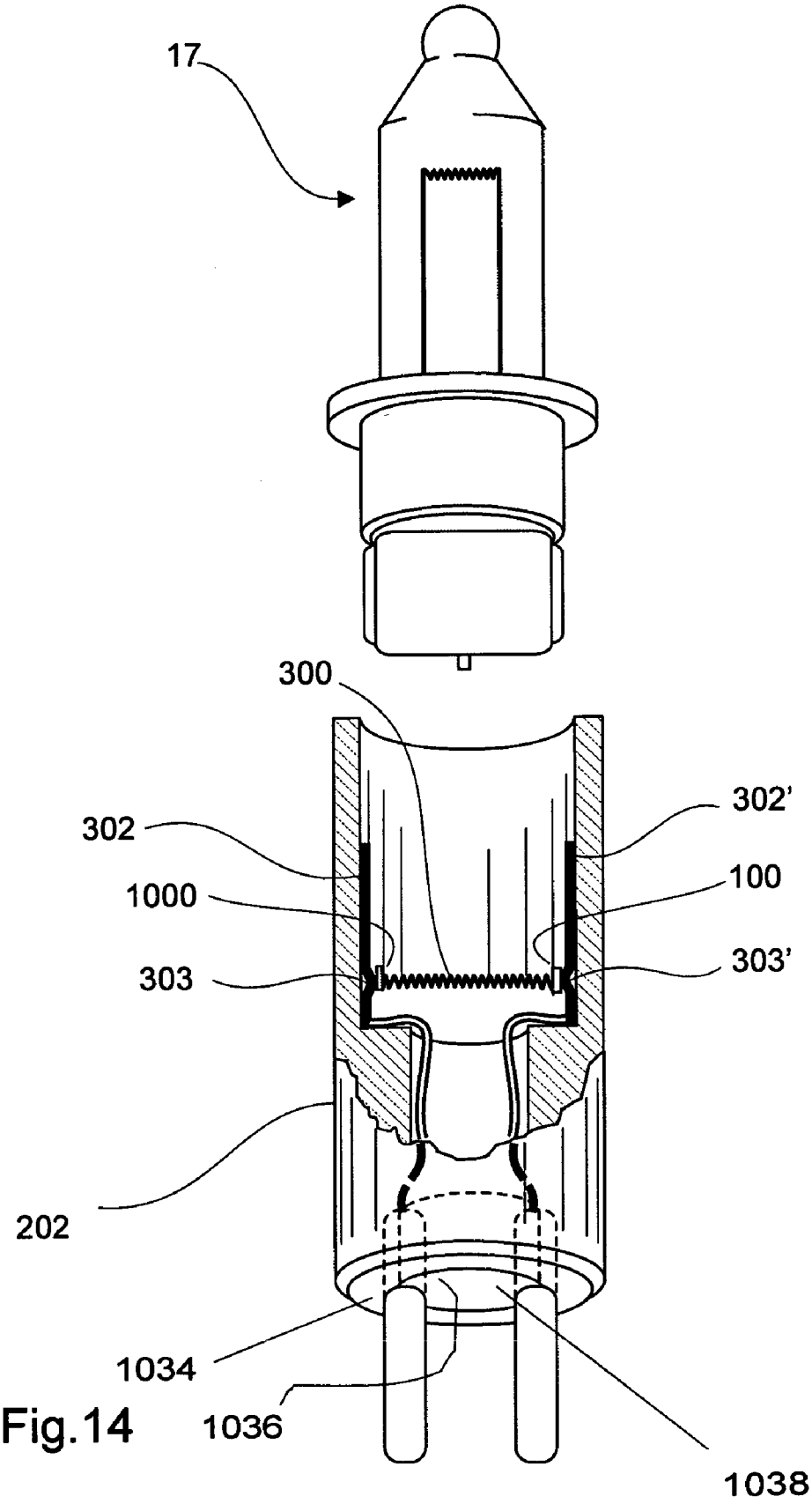
FIG. 14 is a partial sectional view of another embodiment of the invention employing the container and chip of FIG. 7.

FIG. 6 shows another embodiment. Here, the operation is similar to that of FIG. 5. However, a conductive compression spring 300 is used to connect chips 10 and 10' with each end of the spring 300 conductively connected to one side of the respective chips 10 and 10'. The spring 302 is configured to bias the chips 10 and 10' into retained conductive contact with terminals 302 and 302' in socket 350 below where the light bulb 17 is operatively seated. Once operatively disposed in the socket 350, the chips 10 and 10' can be bonded to the terminals 302 and 302', if desired, or contact allowed to be made by the compression spring 300. FIG. 14 shows a similar embodiment with the container 1000 having chip 10 therein operably disposed between the spring 300. Here, terminals 302 and 302' can include an inwardly protruding portion 303 and 303' to assure contact of the chip 10 within the container 1000.

By way of example, a bottom surface 1034 of the socket 12 shown in FIGS. 10-14 can include a plug inlet 1036 to receive a plug 1038. The plug 1036 can be inserted subsequent to the insertion of the container 1000 with chip 10 through the plug inlet 1034. Once the container 1000 with chip 10 and plug 1038 are inserted, epoxy can be added as necessary or desired for a particular embodiment in order to fix the position of the container 1000 and chip 10 with respect to a particular electrical contact.

The above described embodiments are set forth by way of example and are not for the purpose of limiting the present invention. It will be readily apparent to those skilled in the art that obvious modifications, derivations and variations can be made to the embodiments without departing from the scope of the invention. Accordingly, the claims appended hereto should be read in their full scope including any such modifications, derivations and variations.

What is claimed is:

1. A shunt device for use in a light socket in a light string having at least two said light sockets connected in series, wherein each said socket receives a light bulb, wherein said socket includes a housing having a pair of conductive terminals to operatively connect and receive part of a light bulb in an upper portion of the housing and leaving a lower portion of said housing unoccupied by the light bulb, and each terminal is operatively connected to a wire leading outside the housing, which includes:

a first semiconductor chip;

a first container having a receiving surface for receiving said first semiconductor chip therein and having an open surface through which said first semiconductor chip is exposed; and a first conductive member includes a spring having a first end connected to said first semiconductor chip through said open surface and a second end connected to a first terminal and wherein said first container, said first semiconductor chip and said member are operatively interposed in a self retained manner between the terminals in the lower portion of the housing.

2. The shunt device of claim 1, wherein said container is characterized to be of a non-conductive material.

3. The shunt device of claim 1, wherein said first conductive member is bonded to said chip.

4. The shunt device of claim 1, wherein said first conductive member is bonded to said chip.

5. The shunt device of claim 1, which includes a second conductive member having a first end connected to said first semiconductor chip and a second end connected to a second terminal and wherein said container and said chip and said conductive members are operatively interposed in a self retained manner between said terminals.

6. The shunt device of claim 5, wherein said first end of said conductive members include a bent portion configured to retain said container and said chip therebetween.

7. The shunt device of claim 5, wherein said first end of said conductive members include retention fingers which are opposing each other in a spaced relationship in a manner to form a retaining seat for said container and said chip disposed between the fingers to retain said container and said semiconductor chip therebetween.

8. The shunt device of claim 1, wherein a detent mechanism is operably disposed between semiconductor chip and said first conductive member.

9. A shunt device for use in a light socket in a light string having at least two said light sockets connected in series, wherein each said socket receives a light bulb, wherein said socket includes a housing having a pair of conductive terminals to operatively connect and receive part of a light bulb in an upper portion of the housing and leaving a lower portion of said housing unoccupied by the light bulb, and each terminal is operatively connected to a wire leading outside the housing, which includes:

a first semiconductor chip;

a first container having a receiving surface for receiving said first semiconductor chip therein and having an open surface through which said first semiconductor chip is exposed;

a first conductive member includes a spring having a first end connected to said first semiconductor chip through said open surface and a second end connected to a first of the terminals;

a second semiconductor chip; and a second container having a receiving surface for receiving said second semiconductor chip therein and having an open surface through which said second semiconductor chip is exposed, and wherein said containers, said chips and said conductive member are operatively interposed in a self retained manner between the terminals in the lower portion of the housing.

10. The shunt device of claim 9, wherein said first conductive member is bonded to each said chip.

11. The shunt device of claim 9, wherein each said chip is bonded to one of said terminals.

12. The shunt device of claim 9, wherein a detent mechanism is operably disposed between said semiconductor chips and said terminals.

13. A light socket for use with a light string having at least two said light sockets connected in series, wherein each said socket receives a light bulb, wherein said socket includes:

a housing having a pair of conductive terminals to operatively connect and receive part of a light bulb in an upper portion of said housing and leaving a lower portion of said housing unoccupied by said light bulb, and each said terminal operatively connected to a wire leading outside said housing;

a first semiconductor chip;

a first container having a receiving surface for receiving said first semiconductor chip therein and having a first open surface through which said first semiconductor chip is exposed and a second open surface through which said first semiconductor chip is exposed;

a first conductive member has a first end connected to a first side of said first semiconductor chip through said first open surface;

a second conductive member has a first end connected to said second side of said first semiconductor chip through said second open surface wherein said terminals each have a plug-in socket surface formed therein which reside in said lower portion of said housing, and said first conductive member has a second end end configured to plug into one of said plug-in socket surfaces and said second conductive member has a second end end configured to plug into another of said plug-in socket surfaces.

14. The light socket of claim 13, wherein said conductive members are bonded to said sides of said chip.

15. The light socket of claim 13, wherein said container and said chip are operatively interposed in a self retained manner between said terminals in said lower portion of said housing.

16. The light socket of claim 13, wherein said conductive members include a spring.

17. A light socket for use with a light string having at least two said light sockets connected in series, wherein each said socket receives a light bulb, wherein said socket includes:

a housing having a pair of conductive terminals to operatively connect and receive part of a light bulb in an upper portion of said housing and leaving a lower portion of said housing unoccupied by said light bulb, and each said terminal operatively connected to a wire leading outside said housing;

a first semiconductor chip;

a first container having a receiving surface for receiving said first semiconductor chip therein and having a first open surface and a second open surface through which said first semiconductor chip is exposed;

a first conductive member connected to a first side of said first semiconductor chip through said first open surface and wherein a second side of said chip is conductively connected to a first terminal; and a second semiconductor chip wherein said first conductive member is connected to a first side of said second semiconductor chip and wherein a second side of said second semiconductor chip is conductively connected to a second terminal.

18. The light socket of claim 17 wherein said conductive member is bonded to said sides of said chip.

19. The light socket of claim 17, wherein said container and said chip are operatively interposed in a self retained manner between said terminals in said lower portion of said housing.

20. The light socket of claim 17, wherein said conductive members includes a spring.

* * * * *